United States Patent [19]

Spector

[11] Patent Number: 5,031,908

[45] Date of Patent: Jul. 16, 1991

[54] BALLOON GAME SET FOR CEILING PLAY

[76] Inventor: Donald Spector, 380 Mountain Rd., Union City, N.J. 07087

[21] Appl. No.: 586,236

[22] Filed: Sep. 21, 1990

[51] Int. Cl.[5] ..... A63F 9/00

[52] U.S. Cl. ..... 273/447; 273/346; 273/DIG. 30; 273/140; 273/458; 446/220; 446/225

[58] Field of Search ..... 273/199 G, DIG. 30, 273/412–414, 331–335, 359, 344–347, 140, 362–365; 446/220–226, 901

[56] References Cited

U.S. PATENT DOCUMENTS

| | | | |
|---|---|---|---|
| 2,557,789 | 6/1951 | Lamka | 273/140 |
| 3,230,663 | 1/1966 | Shabram | 446/224 |
| 3,463,494 | 8/1969 | Stroh | 273/345 |
| 3,788,641 | 1/1974 | Lemelson | 273/DIG. 30 X |
| 3,830,498 | 8/1974 | Lauzon | 273/365 |
| 3,941,384 | 3/1976 | Wopschall | 446/220 X |
| 3,970,308 | 7/1976 | Christie | 273/365 X |
| 4,077,588 | 3/1978 | Hurst | 446/226 X |
| 4,693,695 | 9/1987 | Cheng | 446/220 |
| 4,824,414 | 4/1989 | Goldblatt | 446/226 |
| 4,888,836 | 12/1989 | Calderwood | 446/220 X |

FOREIGN PATENT DOCUMENTS

| | | | |
|---|---|---|---|
| 1346427 | 11/1963 | France | 446/225 |

OTHER PUBLICATIONS

Playthings, 7–1979, Velcro Fastening Systems Ad.

*Primary Examiner*—Paul E. Shapiro
*Attorney, Agent, or Firm*—Michael Ebert

[57] ABSTRACT

A game set for ceiling play composed of a shaped lighter-then-air master balloon tethered to a line to be held by the player, and a group of shaped lighter-then-air, free-floating slave balloons which when released rise to the ceiling of a play room. The respective balloon shapes and their number are appropriate to the game. Thus in a fishing game, the shapes of the slave balloons are those of different species of fish, and that of the master balloon is of a standard float at the end of a fishing line. Attached to the surface of the master balloon is a patch forming one element of a velcro fastener, and attached to the surface of each slave balloon is a patch forming the complementary element. In ceiling play, the player seeks by manipulating the tethered master balloon to position it so that the patch thereon engages the complementary patch on a selected slave balloon on the ceiling, at which point the caught slave balloon can be brought down from the ceiling.

10 Claims, 2 Drawing Sheets

BALLOON GAME SET FOR CEILING PLAY

BACKGROUND OF INVENTION

1. Field of Invention

This invention relates generally to helium-inflated toy balloons, and more particularly to a play set which makes use of such balloons for ceiling play, one of the balloons being tethered and being manipulated by a player to capture the other balloons which are free-floating and rise to the ceiling.

2. Status of Prior Art

Toy balloons are known in which the skin of the balloon is composed of non-stretchable MYLAR (polyester) film whose surface is metallized and otherwise embellished. The balloon is formed from two contoured sheets of Mylar film which when peripherally bonded together create an internal cavity and a neck leading to the cavity. By inflating this balloon with helium through the neck, and then knotting or otherwise sealing the neck, the resultant balloon is lighter than air and therefore free floating.

The usual practice when a MYLAR balloon is sold to a child, say, in an amusement park, is for the vendor to fill the purchased balloon through its neck from a large cylinder containing pressurized helium, after which he knots the neck to seal the balloon, and then ties a string to the neck which he hands over to the child. The tethered balloon then floats upwardly to a height depending on the length of the string.

Such lighter-than-air toy balloons have limited play value; for while a child enjoys holding the balloon by its string as he walks through an amusement park or along a street, should the child accidentally release the string, the balloon then rises and is blown away so that it cannot be recovered. More expensive versions of a Mylar balloon are in the shape of popular characters such as Mickey Mouse, and the loss of a balloon of this type is not taken lightly by the child. If, however, this lighter-than-air balloon is released within the confines of the child's playroom, it will float to the ceiling, and in that case it can be recovered by stepping on a chair or step-ladder.

The effective life, in its inflated state, of a conventional balloon having a thin rubber skin is short. When this balloon is mouth inflated by air, it is blown up by internal pressure well above atmospheric in order to stretch the skin and expand the balloon to a large size. Not only are such air-filled balloons incapable of floating in air, but because of their high internal pressure, air gradually leaks out of the knotted neck to deflate the balloon.

But a helium-filled, lighter-than-air MYLAR balloon has a low internal pressure, for with this non-stretchable balloon, the internal pressure need only be sufficient to cause the balloon to assume its predetermined shape. And the great advantage of a MYLAR balloon is that it may be pre-shaped to assume an endless range of fanciful configurations, and its non-stretchable skin may be metallized, printed in multi colors and otherwise embellished in imaginative ways.

But regardless of the attractive form taken by a Mylar lighter-than-air balloon, there is not much a child can do other than to admire it and walk with the balloon floating in air above him. Indeed, the play possibilities of a MYLAR balloon are so limited that some children will deliberately release the balloon, even though in doing so, the balloon will be lost. However, the child then has the joy (as with a pet bird released from its cage) of seeing the balloon fly away and thereby gain its freedom.

SUMMARY OF INVENTION

In view of the foregoing, the main object of this invention is to provide a game set for ceiling play which makes use of lighter-than-air toy balloons having predetermined shapes.

A significant advantage of a game set in accordance with the invention is that it greatly enhances the play value of the balloons, for one can then not only admire the fanciful forms of the balloons, but one is also able to manipulate these balloons in competitive play activity. Moreover, while all but one of these balloons are free-floating, these balloons rest against the ceiling of the room in which the game is played and can readily be recovered without the need for a step ladder.

More particularly, an object of this invention is to provide a game set for ceiling play in which the lighter-than-air balloons are MYLAR balloons filled with helium. Such balloons are innocuous, for even if punctured, the balloon will not explode but simply deflate.

Also an object of this invention is to provide a relatively inexpensive balloon game that makes it possible for a player to engage in highly enjoyable games, either by himself or in competition with other players.

Yet another object of the invention is to provide a balloon game set of the above type which can be compactly packaged for storage, display and transportation.

Briefly stated, these objects are attained in a game set for ceiling play composed of a shaped lighter-then-air master balloon tethered to a line to be held by the player, and a group of shaped lighter-then-air free-floating slave balloons which when released rise to the ceiling of a play room. The balloon shapes and their number are appropriate to the game. Thus in a fishing game, the shapes of the slave balloons are those of different species of fish, and that of the master balloon is of a standard float at the end of a fishing line.

Attached to the surface of the master balloon is a patch forming one element of a VELCRO fastener, and attached to the surface of each slave balloon is a patch forming the complementary element. Other known forms of two-element coupling means may also be used. In ceiling play, the player seeks by manipulating the tethered master balloon to position it so that the patch thereon engages the complementary patch on a selected slave balloon on the ceiling, at which point the caught slave balloon can be brought down from the ceiling.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

A game set for ceiling play in accordance with the invention is composed of at least one shaped helium-inflated master balloon tethered to a line to be held by a player, and a plurality of shaped helium-inflated slave balloons which are free-floating, so that when released within a play room or other chamber, the slave balloons rise to the ceiling and are disposed along its surface. The respective shapes of the balloon and their number are appropriate to the game.

Figure 1:
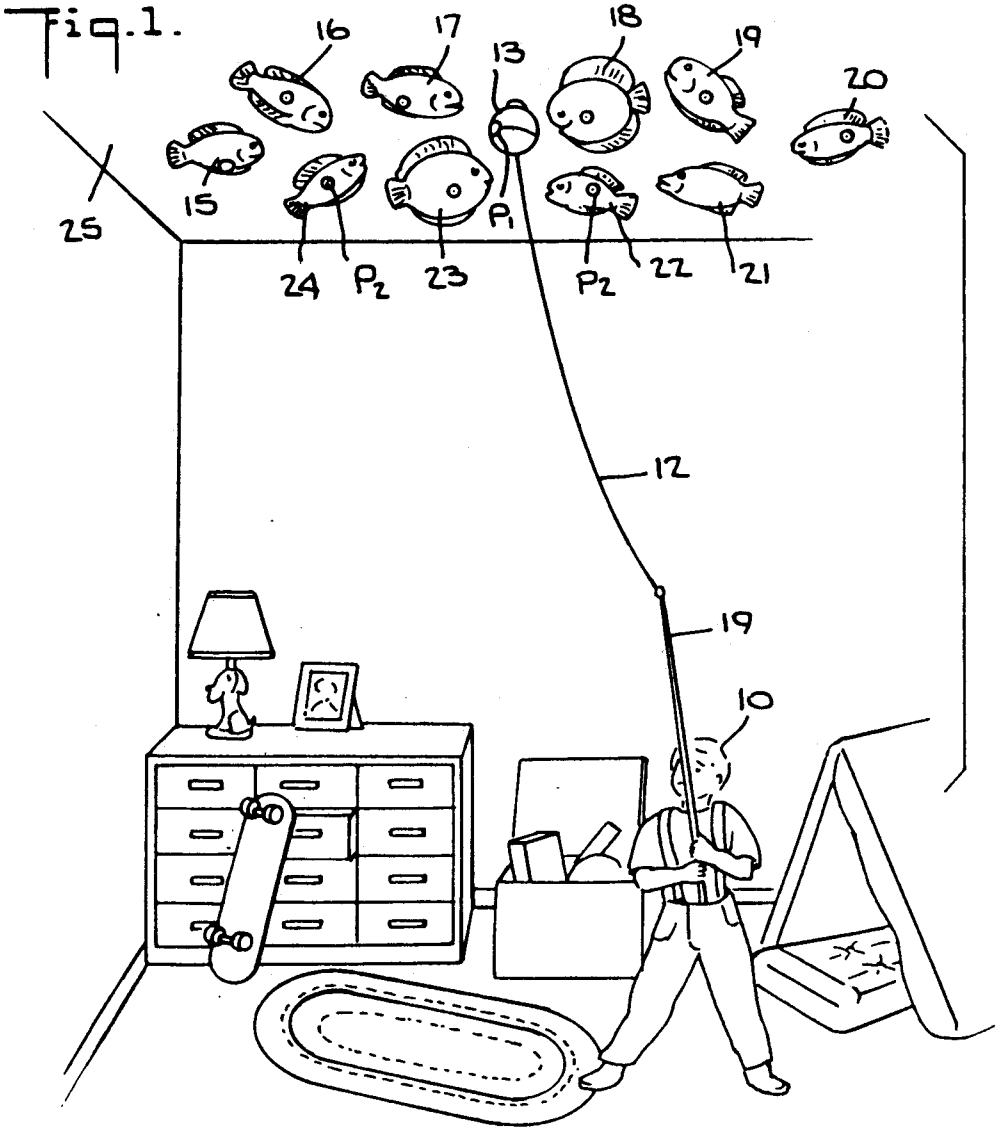
FIG. 1 illustrates one version of a balloon game set for ceiling play in which the game is a fishing game.

Thus in FIG. 1, the game set illustrated is that of a fishing game in which a child 10 holds a fishing pole 11 having a reel from which extends a line 12 that the child can reel in or out. The end of line 12 is tied to a master balloon 13 which is a helium-inflated balloon shaped to resemble a standard fishing float of the type attached to a fishing line adjacent to the fish hook.

However, instead of a hook, attached to the outer surface of the master balloon 13 is a patch $P_1$ forming one element of a coupler, such as a small sheet-like permanent magnet or a double-faced sheet of pressure-sensitive material whose inner face is secured to the balloon surface and whose outer face is exposed. Preferably, patch 14 is the male or female element of a fabric VELCRO fastener, for a fastener of this type can be ultrasonically or otherwise bonded without difficulty to a MYLAR film surface.

Also included in the game set are a plurality of shaped helium-inflated, free-floating slave balloons 15 to 24 which float to the ceiling 25 of the play room. The slave balloons in the fishing game are shaped to resemble various species of fish. Each slave balloon has attached to its outer surface a patch $P_2$ which complements patch $P_1$ on the master balloon . Thus in the case of a permanent magnet, one patch is oriented to expose its north pole and the other its south pole. And in the case of a VELCRO fastener, one patch is the female or looped element of the fastener, while the other is the male or hooked element which is engageable with the looped element. In a VELCRO fastener, the element thereof can readily be disengaged.

Hence to play the fishing game, the child 10 first releases slave balloons 15 to 24 to permit them to float toward the ceiling and occupy scattered positions thereon. The bigger the ceiling area, the greater is the number of slave balloons that can be released. The player then unreels the tethered master balloon 13 so that it is close to the ceiling, and he then proceeds to manipulate fishing pole 11 so as to bring the patch $P_1$ on the master balloon into engagement with patch $P_2$ on a selected slave balloon. How difficult this is depends on the size and placement of the patches. But in the case of a Velcro fastener, as long as even a small zone on one patch makes contact with a small zone on the other patch, the Velcro elements will intercouple.

Once the fastener elements connect, the selected fish-shaped slave balloon is caught and now it can be brought down (out of the water, as it were) by reeling in the master balloon which in this instance functions effectively as the fishing hook. The game is completed when all of the slave balloons have been captured and brought down from the ceiling.

To play the game competitively, two players are provided with fishing lines on which a master balloon is tethered, and the players compete to see who is the first to catch and bring down five balloons or whatever other number is decided on as representing a winning score.

Figure 2:
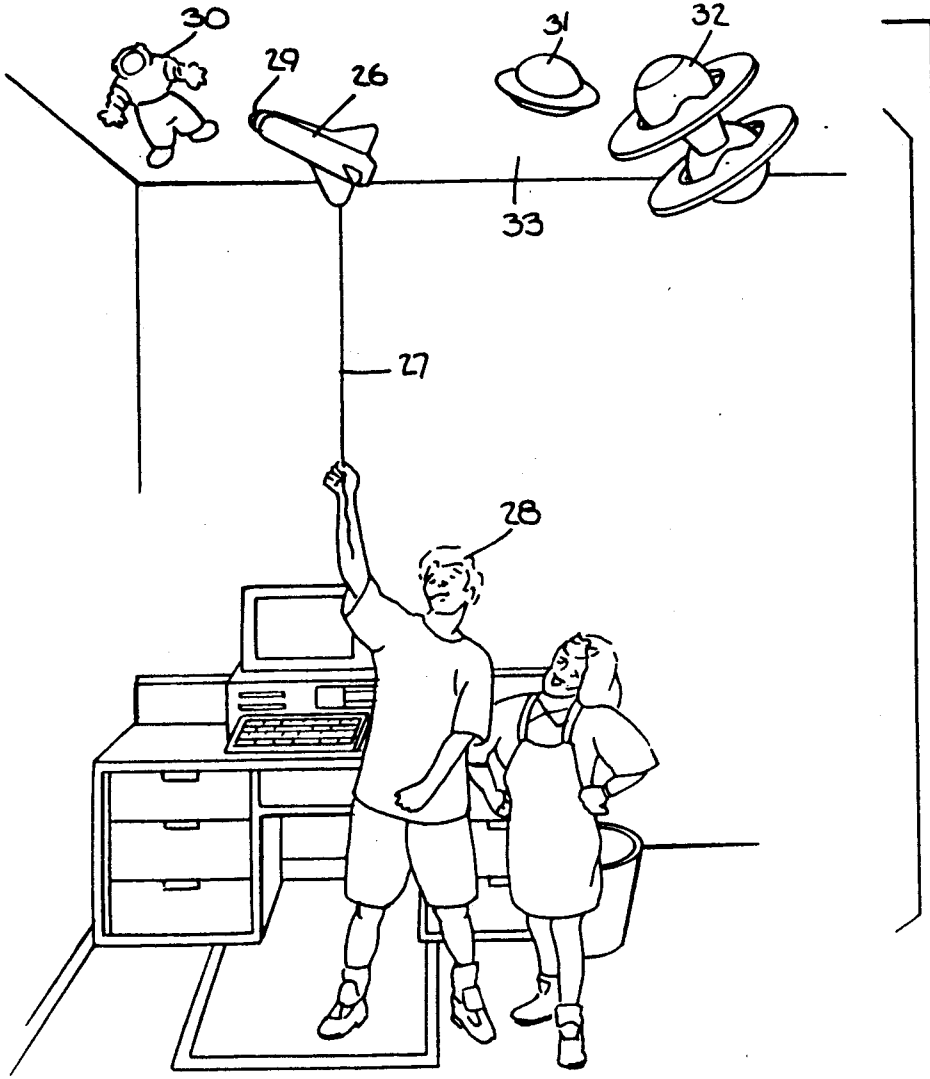
FIG. 2 illustrates another version in which the game is a flying saucer game.

In the flying saucer or outer space game set shown in FIG. 2, the master balloon in this instance is in the form of a space ship 26 tethered by a line 27 held by player 28, the master balloon having a coupler patch 29 on the nose of the ship. The free-floating slave balloons in this instance are in the form of an astronaut 30, a small flying saucer 31 and a double-decker flying saucer 32, all floating on ceiling 33. In this instance, the object of the game is for the master space ship balloon to capture and bring down from the ceiling the free-floating slave balloons.

Another version of the game, which is not illustrated, is for the master balloon to have a cat-like shape and for the slave balloons to look like mice. It will be appreciated that many versions are possible, but that in each case, the nature of the master balloon must be such that it has a functional affinity for the slave balloons.

Figure 3:
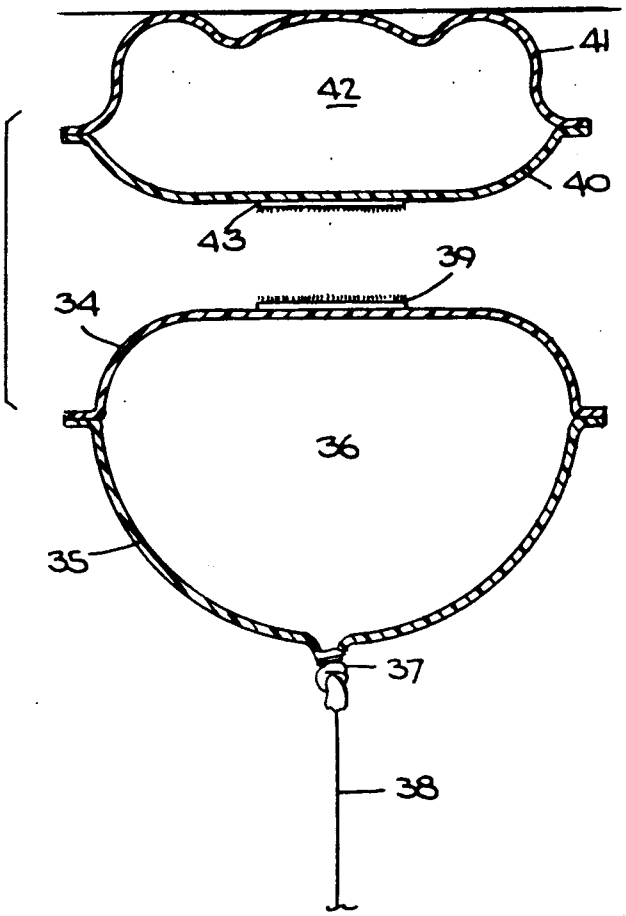
FIG. 3 illustrates, in section, the master balloon of the game set and one of the slave balloons to be captured by the master balloon.

As shown in FIG. 3, a typical master balloon is composed of two contoured MYLAR sheets 34 and 35 which are peripherally bonded to define a cavity 36 as well as a neck 37 leading into the cavity. The balloon is inflated with helium through the neck which is then knotted to seal the neck and tied to a string or line 38.

Attached to the upper surface of the master balloon is one element 39 of a VELCRO fastener. The slave balloon which is formed of Mylar sheets 40 and 41 are appropriately contoured and peripherally bonded to define a cavity 42. But the slave balloon has no string attached thereto, for it is free floating. The slave balloon is provided with a patch 43 forming the complementary element of the coupler or fastener.

Figure 4:
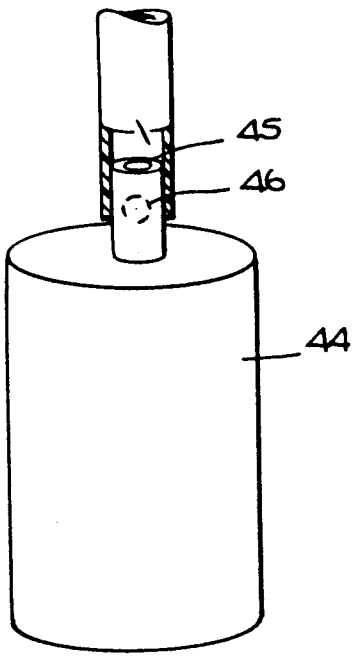
FIG. 4 shows a small pressurized-helium gas cartridge for inflating the balloons in the set.

To inflate the balloons in the set in the home, the player is provided with a small cartridge 44, as shown in FIG. 4, containing pressurized helium which is discharged through a small diameter nozzle 45 when the button 46 of a valve is actuated to release the helium into the neck 46 of a balloon into which nozzle 45 is telescoped. The capacity of the cartridge is such as to provide sufficient helium to inflate all of the balloons in the set.

In practice, the balloons of the game set may be inflated in the store selling the set from a large pressurized helium supply cylinder, but then the purchaser has to take the balloons home in their inflated lighter-than-air state. But in that case, all of the inflated balloons may be gathered within a large net bag which is tethered so that now, in carrying the set home, one travels with a tethered large net bag, a dramatic experience that is part of the fun.

While there has been shown and described a preferred embodiment of a balloon game set for ceiling play in accordance with the invention, it will be appreciated that many changes and modifications may be made therein without, however, departing from the essential spirit thereof. Thus one element of the coupler may be a small loop attached to each of the slave balloons, and the other element a hook attached to the master balloon which is engageable with the loop.

I claim:

1. A balloon game set for ceiling play comprising:

(a) a lighter-than-air toy master balloon whose shape is appropriate to the role played by this balloon in a game in which the master balloon seeks to selectively capture slave balloons, said master balloon being tethered to a line to be held by a player;

(b) a group of lighter-than-air toy slave balloons having different shapes appropriate to the role played by the slave balloons in the game, said slave balloons being free-floating so that when released they float toward the ceiling of the room in which the game is played; and (c) two-element coupling means making it possible for the master balloon to capture a slave balloon selected from the group, said means being formed by a first element attached to the surface of the master balloon, and a complementary second element attached to the surface of each slave balloon, whereby when the tethered master balloon is manipulated by the player to cause the first element thereon to engage the complementary second element of the selected slave balloon, the slave balloon so captured may then be brought down from the ceiling.

2. A balloon game as set forth in claim 1, wherein the master balloon is shaped to form an object having a functional affinity for the objects represented by the slave balloon shapes.

3. A balloon game set as set forth in claim 1, wherein said game is a fishing game and said slave balloons are shaped to represent different species of fish.

4. A balloon game set as in claim 3, wherein the master balloon has the shape of a fishing line float and functions effectively as a fishing hook to catch the fish.

5. A balloon game as set forth in claim 1, wherein said game is an outer space game, and the master balloon has the shape of a space ship.

6. A balloon game set as set forth in claim 5, wherein said group of slave balloons include balloons in the shape of flying saucers.

7. A game set as set forth in claim 1, wherein said balloons are formed of a skin of non-stretchable polyester film, the balloon having a neck which leads to a cavity in the balloon.

8. A game set as set forth in claim 7, wherein the cavity in each balloon is filled with helium through said neck.

9. A game set as set forth in claim 8, wherein said game set includes a valve-controlled cartridge containing pressurized helium in an amount sufficient to fill the balloons, said cartridge having a nozzle adapted to be telescoped in said neck.

10. A game as set forth in claim 1, wherein said coupling means is constituted by a VELCRO fastener having male and female elements, one of these elements being the first element, and the other, the second complementary element.

* * * * *